US005524447A

United States Patent [19]

Shim

[11] Patent Number: 5,524,447

[45] Date of Patent: Jun. 11, 1996

[54] TEMPERATURE CONTROL METHOD OF REFRIGERATOR

[75] Inventor: Jae-Eok Shim, Kyungki-do, Rep. of Korea

[73] Assignee: Samsung Electronics Co., Ltd., Suwon, Rep. of Korea

[21] Appl. No.: 288,235

[22] Filed: Aug. 9, 1994

[30] Foreign Application Priority Data

Aug. 9, 1993 [KR] Rep. of Korea ..... 1993-15409

[51] Int. Cl.[6] ..... F25D 17/04

[52] U.S. Cl. ..... 62/209; 62/187; 236/91 R

[58] Field of Search ..... 62/209, 208, 187, 62/186, 203, 229; 236/91 R, 91 E, 91 F, 91 G

[56] References Cited

U.S. PATENT DOCUMENTS

| | | | |
|---|---|---|---|
| 4,089,462 | 5/1978 | Bradford | 236/91 R X |
| 4,407,141 | 10/1983 | Paddock | 62/209 X |
| 4,495,780 | 1/1985 | Kaneko et al. | 62/209 X |
| 4,879,878 | 11/1989 | Polkinghorne | 62/187 |
| 4,924,680 | 5/1990 | Janke et al. | 62/187 |
| 5,201,888 | 4/1993 | Beach, Jr. et al. | 62/187 |
| 5,263,335 | 11/1993 | Isono et al. | 62/209 X |

*Primary Examiner*—Harry B. Tanner
*Attorney, Agent, or Firm*—Burns, Doane, Swecker & Mathis

[57] ABSTRACT

When a user manually sets a desired (target) temperature for a refrigerator chamber, a control mechanism automatically determines a range of target temperatures having upper and lower limits. Actuation and deactuation of the refrigeration cycle is controlled in response to a comparison of the chamber temperature with the upper and lower limits, respectively. When an outside temperature surrounding the refrigerator rises above a reference temperature, those upper and lower limits are automatically lowered. Also, the control mechanism compares the manually set temperature with a range of temperatures which the refrigerator is capable of achieving and automatically selects an achievable temperature if the manually selected temperature lies outside the achievable range. Moreover, a quick-freeze operation of the control mechanism enables a freezing chamber to be brought rapidly to a cold temperature. Furthermore, the temperature balance between freezing and refrigerating chambers of the refrigerator is controlled by an actuator-driven damper. Once a sensor signals that the damper has arrived at an open or closed position, the damper is continued to be driven for a predetermined time period to compensate for the possibility that the damper-arrival signal was produced prematurely.

4 Claims, 5 Drawing Sheets

TEMPERATURE CONTROL METHOD OF REFRIGERATOR

BACKGROUND OF THE INVENTION

1. Field of the Invention

The present invention relates to a temperature control method of a refrigerator, and more particularly to a temperature control method of the refrigerator for controlling a temperature in a refrigerating chamber.

2. Description of the Prior Art

A refrigerator is usually composed of a refrigerating chamber and a freezing chamber.

The refrigerator thus divided into the refrigerating chamber and the freezing chamber operates such that cold air of the freezing chamber is supplied to the refrigerating chamber.

The cold air is controlled by a damper disposed at a passage for connecting the refrigerating chamber to the freezing chamber through which cold air is supplied from the freezing chamber to the refrigerating chamber.

FIG. 1 is a block diagram of a temperature control circuit in a conventional refrigerator thus described.

In FIG. 1, reference numeral 10 is an operating unit comprising a temperature control switch (or lever) for setting temperatures in the refrigerating chamber, freezing chamber and the like of the refrigerator by way of instructions inputted by a user.

Reference numeral 20 is a temperature sensing unit for sensing the temperatures by way of temperature sensors disposed at the refrigerating chamber, freezing chamber and the like.

Reference numeral 30 is a damper sensing unit for sensing an opening and closing of the damper for supplying or cutting off the cold air to the refrigerating chamber and the like.

Reference numeral 40 is a control unit for outputting a predetermined control signal for controlling the refrigerator according to outputs of the operating unit 10, temperature sensing unit 20 and the damper sensing unit 30.

Reference numeral 50 is a display unit for operating in accordance with the control signal output from the control unit 40 and to display the state of the refrigerator.

In other words, the display unit displays the temperatures of the refrigerating chamber, freezing chamber and the like.

Reference numeral 60 is a damper driving unit for operating the damper according to the control signal output from the control unit 40.

In the refrigerator having the temperature control circuit mentioned above, the user sets the temperatures in the refrigerating chamber, freezing chamber and the like by way of an operation unit 10. The temperature set by the user can be termed a target temperature. The selecting of a target temperature automatically results in the creation of a target temperature range having upper and lower limits or reference temperatures Tr1 and Tr2.

When the temperature is set by the user, the control unit 40 compares reference temperature with the detected temperature in the refrigerating chamber or freezing chamber by way of the temperature sensing unit 20.

As a result of that comparison, if the detected temperature detected by the temperature sensing unit 20 reaches the first reference temperature Tr1 as illustrated by a solid line in FIG. 2, the control unit 40 outputs the control signal to the damper driving unit 60 to thereby open the damper, so that the cold air in the freezing chamber can be supplied to the refrigerating chamber.

If the detected temperature reaches the second reference temperature Tr2 as the temperature in the refrigerating chamber goes down due to opening of the damper, the control unit 40 outputs the control signal to the damper driving unit 60 to thereby close the damper, so that the cold air of the freezing chamber supplied to the refrigerating chamber can be cut off.

If supply of the cold air to the refirgerating chamber is cut off due to the close-down of the damper, the temperature of the refrigerating chamber in turn rises up with time.

If the detected temperature in the refrigerating chamber rises up again to thereby reach the first reference temperature Tr1, the damper is opened as described in the foregoing and the cold air is supplied to the refrigerating chamber to thereby lower the temperature of the refrigerating chamber.

As seen from the foregoing, the temperature in the refrigerating chamber varies around the target value To according to the control of the damper by way of the first and second reference temperatures Tr1 and Tr2.

However if an outside temperature of the refrigerator rises up above a predetermined value, there arises a difference between the temperature in the refrigerating chamber detected by the temperature sensing unit 20 and an actual temperature in the refrigerating chamber, due for instance to a time delay between the rising of the actual temperature and the detecting thereof.

In other words, as illustrated in FIG. 2 by the solid lines, the actural temperature in the refrigerating chamber is detected to have reached the first reference temperature Tr1, so that the control unit 40 outputs the control signal to the damper driving unit 60 to thereby open the damper, notwithstanding that the actual temperature in the refrigerating chamber actually was a higher first temperature Te1.

Furthermore, the temperature in the refrigerating chamber is detected to have reached the second reference temperature Tr2, even though the actual temperature was at a higher second temperature Te2, so that the control unit 40 outputs the control signal to the damper driving unit 60 to thereby close the damper at a time which is subsequent to an optimum time for doing so.

As described above, when the outside temperature is above a predetermined value, the temperature in the refrigerating chamber cannot be accurately detected as the outside temperature rises up, whereby the actual temperature in the refrigerating chamber varies around a target temperature value Teo which is higher than the desired target value To.

Accordingly, because the actual temperature of the refrigerating chamber has the predetermined temperature difference (Teo-To), there arises a problem in that the freshness of food stored in the refrigerating chamber deteriorates.

Furthermore, because the user establishes the temperature in the freezing chamber or refrigerating chamber by way of the operation unit 10 (Usually, established ranges are "strong", "intermediate strong", "intermediate", "intermediate weak" and "weak".), there also arises a problem in that the established temperature cannot be accurately detected by the user at the control unit 40 due to electrical noise and the like.

At this time, there usually arises a problem in that erroneous operations are conducted by the control unit 40 because the established temperatures are erroneously interrupted as temperatures situated out of the range which can be achieved by the refrigerator.

Still furthermore, a large amount of cold air should be supplied to the freezing chamber during a quick cooling when the food stored in the freezing chamber is required to be cooled quickly. However, there usually arises a problem in that the quick cooling is not properly realized in the freezing chamber because the damper is caused to open to thereby supply the cold air to the refrigerating chamber when the temperature in the refrigerating chamber reaches the second reference temperature (Tr2) even in the. quick freezing mode.

Meanwhile, a baffle is disposed on the damper for controlling the cool air supplied to the refrigerating chamber, whereas the baffle is closed or opened by rotation of a cam to thereby supply or cut off the cold air to the refrigerating chamber.

At this time, the opening and closing states of the baffle are detected by: a magnet disposed at one end of the cam; a lead switch for being opened or closed when the magnet is approached or distanced thereform according to the closing and opening of the baffle; and a control unit for determining whether the baffle is in a closed or opened state by way of detection of the lead switch being closed or opened.

As mentioned above, the damper, in its operational characteristic when the cam is rotated to thereby open the baffle, causes the lead switch to closed, thereby causing the control unit 40 to determine that the baffle is open.

However, when the cam is rotated to open the closed baffle, the magnet becomes distanced from the lead switch, whereby a contact of the lead switch may become short-circuited before the baffle is fully opened to thereby cause the control unit 40 to determine that the baffle is completely opened.

Furthermore, when the baffle is required to be closed, the magnet approaches the lead switch and may open the contact of the lead switch before the baffle is completely closed, thereby causing the control unit 40 to determine that the baffle is entirely closed.

As described above, because the control unit 40 cannot accurately discriminate whether the baffle of the damper is in operation, there arises a problem in that control of the damper is not accurately performed.

SUMMARY OF THE INVENTION

Accordingly, it is an object of the present invention to provide a temperature control method of a refrigerator for being adapted to variations of outside temperatures to thereby control the temperature in the refrigerator accurately.

Furthermore, it is another object of the present invention to provide a temperature control method of a refrigerator for being adapted to input of noise, selection of quick cooling, operational state of the damper and the like to thereby control the temperature in the refrigerator accurately.

In accordance with one object of the present invention, there is provided a temperature control method of a refrigerator, the method comprising: an outside temperature detecting step for detecting the outside temperature according to a temperature detecting means for detecting the outside temperature of the refrigerator; a compensation discriminating step for discriminating whether or not the outside temperature detected from the outside temperature detecting step is a temperature for compensating a difference between the actual temperature in the refrigerator and a sensed temperature in the refrigerator; a temperature difference correction step for having the temperature established by the user corrected at a temperature difference storage step by an input temperature difference when it is discriminated that the temperature difference should be compensated at the compensation discrimating step; and a damper control step for controlling the damper so that the temperature in the refrigerating chamber can be varied based on the temperature corrected at the temperature difference correction step.

In accordance with another object of the present invention, there is provided a temperature control method of a refrigerator, the method comprising: an established temperature discriminating step of discriminating whether the temperature established and input by the user is within an established range of the refrigerator; a temperature establishing step for establishing the temperature established by the user as an adjustment temperature of the refrigerator when it is discriminated that the temperature established by the user at the established temperature discriminating step is within the established range of the refrigerator, and for establishing a predetermined temperature within the established range of the refrigerator as the adjustment temperature of the refrigerator when it is discriminated that the temperature established by the user at the established temperature discriminating step is not within the established range of the refrigerator; and a damper control step for controlling the damper so that the temperature in the refrigerator can be varied based on the temperature in the refrigerator can be varied based on the temperature established at the temperature established step.

In accordance with still another object of the present invention, there is provided a temperature control method, the method comprising: a temperature establishing step for, in a refrigerator for being divided into a refrigerating chamber and a freezing chamber to thereby cause the cold air in the freezing chamber to be controlled by the damper and the be supplied to the refrigerating chamber, controlling the damper to thereby establish a temperature establishment in the refrigerating chamber to a lowest step when the freezing chamber is selected for a quick cold function by the user; and a damper control step for controlling the damper so that the temperature in the refrigerator can be varied based on the temperature established at the temperature establishing step.

The damper control step in the temperature control method of the refrigerator thus described, the step comprising: a temperature discriminating step for discriminating whether the temperature in the refrigerator detected by the temperature detector is the temperature for closing or opening the damper in a refrigerator where the temperature in the refrigerating chamber is detected by a temperature detecting means, and the damper for controlling the cold air supplied to the refrigerating chamber is closed and opened to thereby control the temperature in the refrigerating chamber according to the temperature established by the user as a reference; a damper operation discrimination step for discriminating whether the damper is conducting a closing operation or an opening operation; and a damper driving step for initializing an overrun time of the damper after discriminating that the damper is completely closed when the damper is performing a closing operation as a result of the discriminations at the temperature discriminated step and the damper operation discriminating step, and for rendering the damper inactivated and initializing the overrun time of the damper after further operating the damper for the overrun time when it is discriminated that the damper is operating the opening process to thereby cause the damper to be discriminated as completely opened.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENT OF THE INVENTION

Figure 3A:
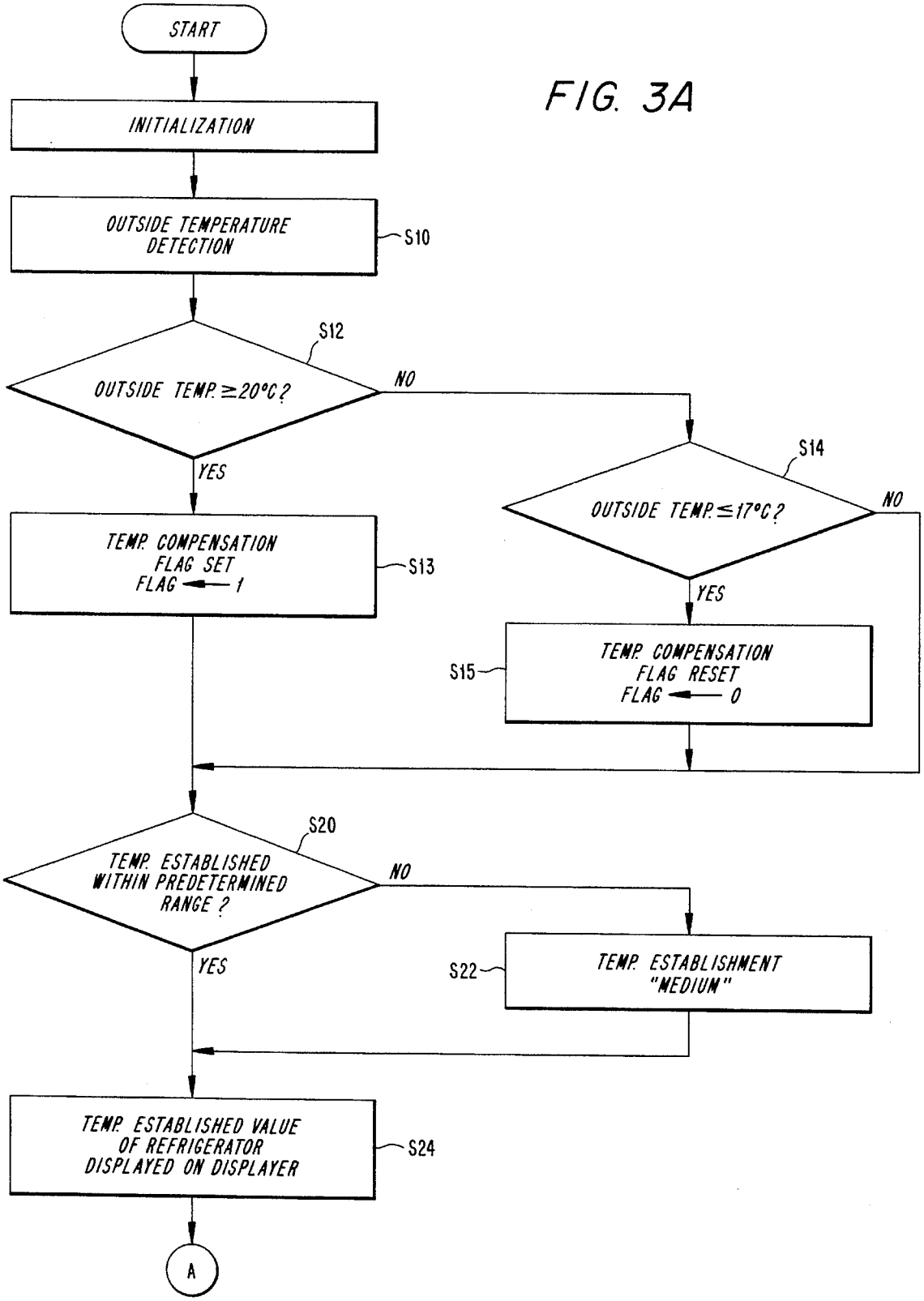
FIGS. 3A, B, C are portions of a flow chart for explaining a damper control method of the refrigerator according to the present invention.

FIG. 3A, B, C are portions of a flow chart for explaining a damper control method of the refrigerator according to the present invention.

As will be explained hereinafter, a refrigerator according to the invention: (a) automatically provides temperature compensation when the outside temperature of the refrigerator exceeds a predetermined reference value (see steps S10 through S15), (b) automatically checks whether a target temperature selected by a user lies within an achievable range (i.e., a range which can be achieved by the refrigerator), and automatically resets the target temperature to a value lying within the achievable range if the user's selected target temperature lies outside the achievable range (see steps S20–S24), (c) enables a user to select a "quick freezing" mode wherein the temperature in the freezing compartment is rapidly brought to a low level (see steps S30–S32), and (d) prevents the occurrence of a situation in which the movement of a flow control damper is prematurely stopped by an erroneous signal from a detector which detects a fully open or fully closed condition of the damper.

Figure 3B:
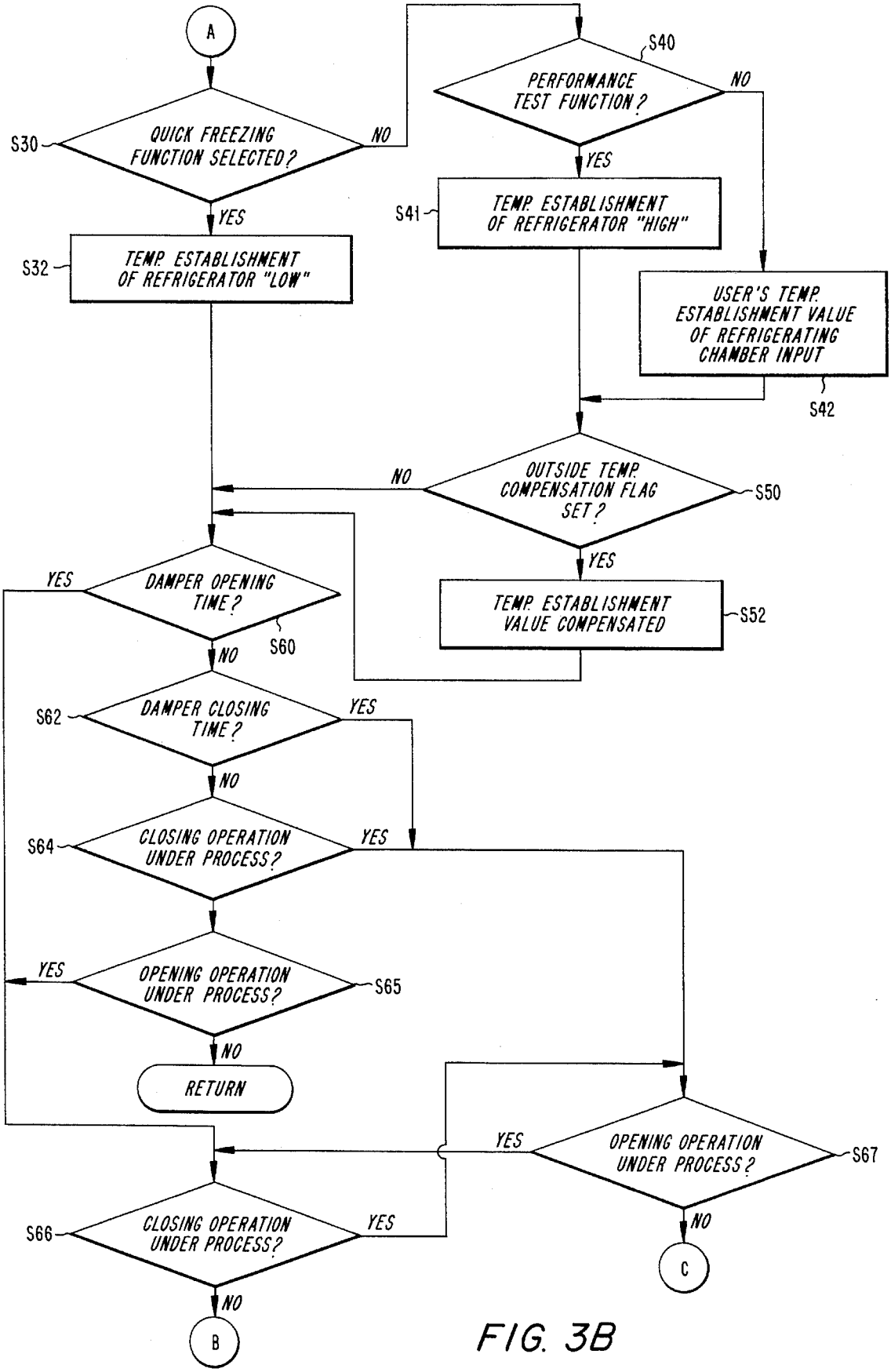
Figure 3C:
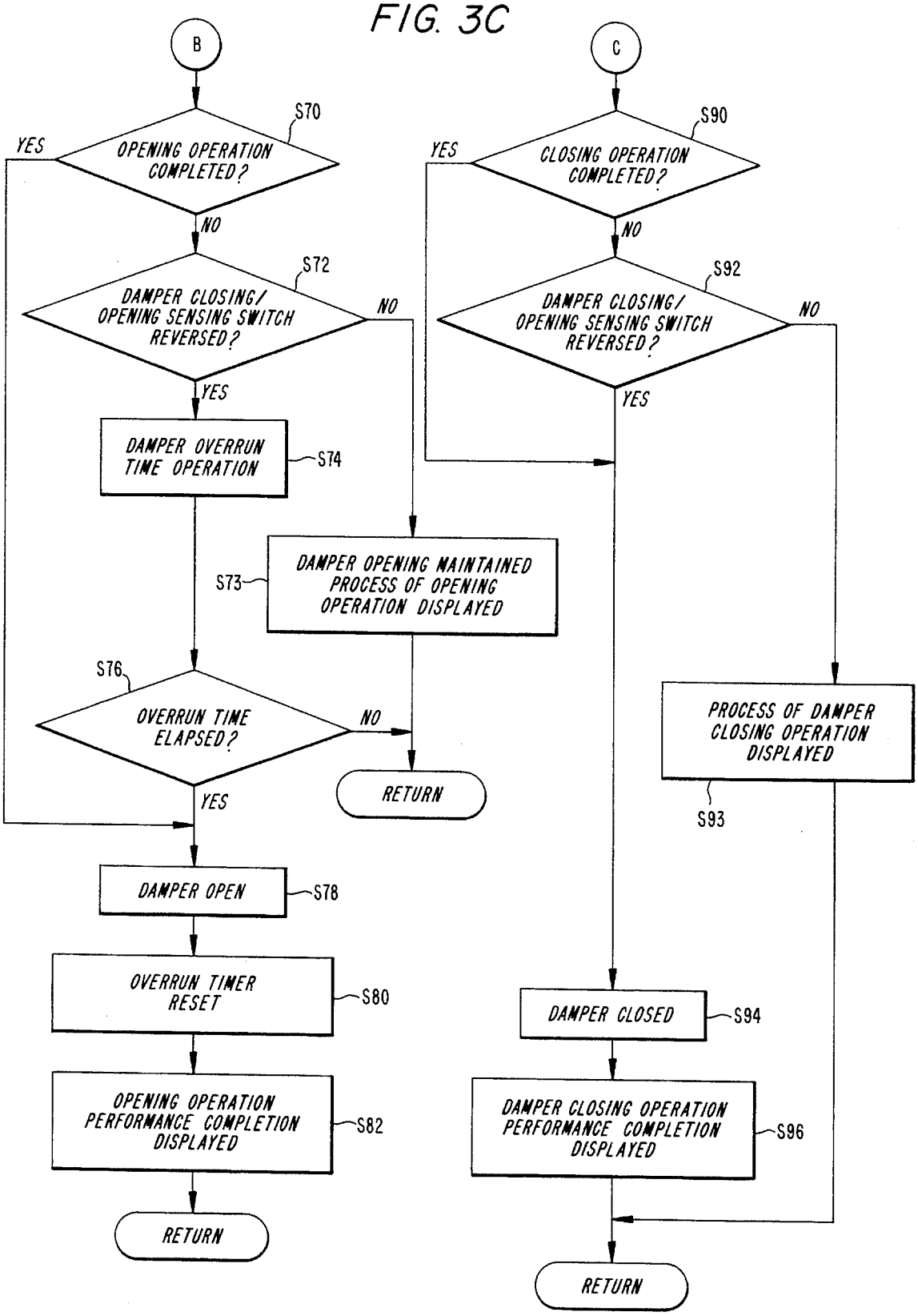

The overall operating sequence and the effect of the present invention will be explained in detail with reference to the flow chart shown in FIGS. 3A–3C.

Figure 1:
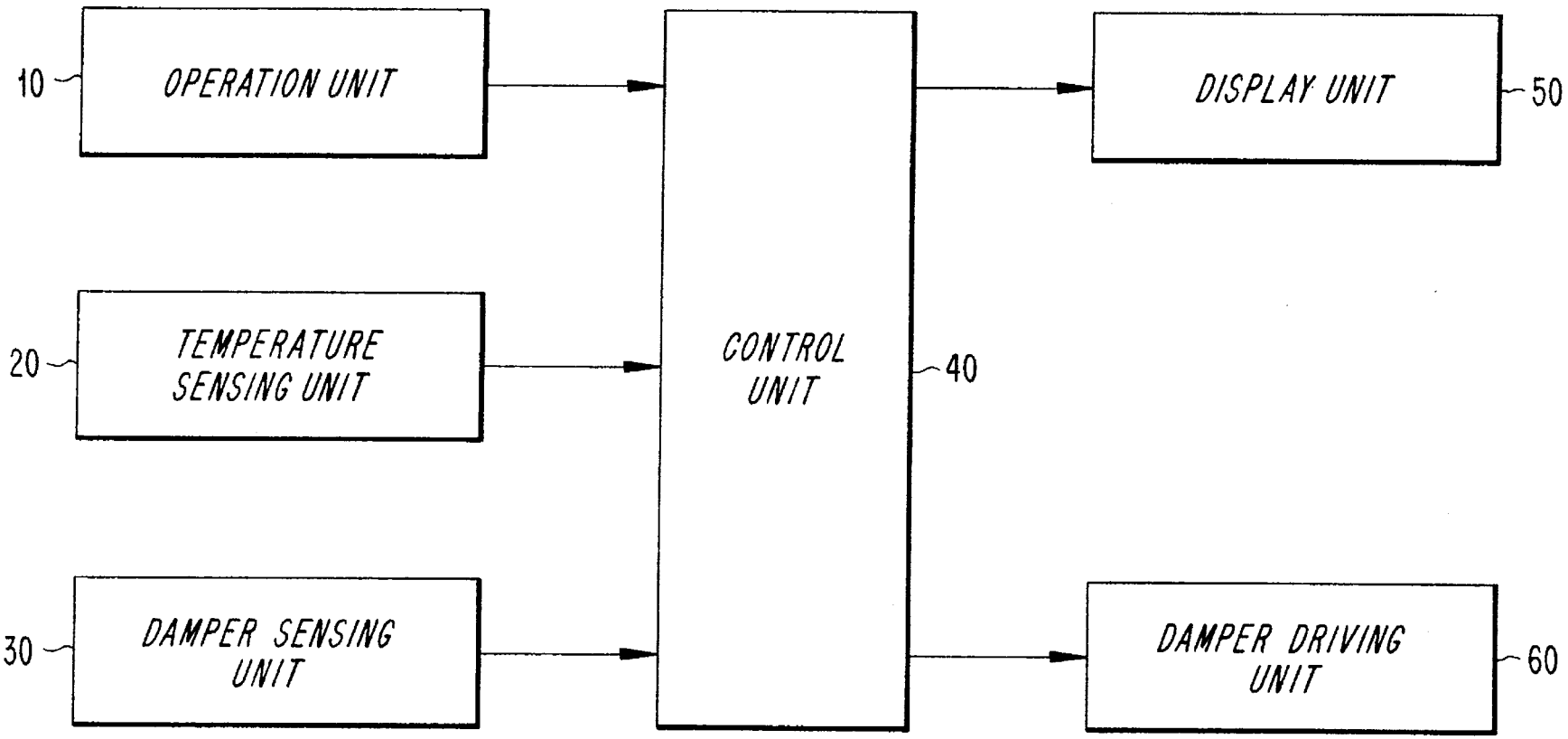
FIG. 1 (PRIOR ART)
FIG. 1 is a block diagram of a temperature control circuit in a conventional refrigerator.
Figure 2:
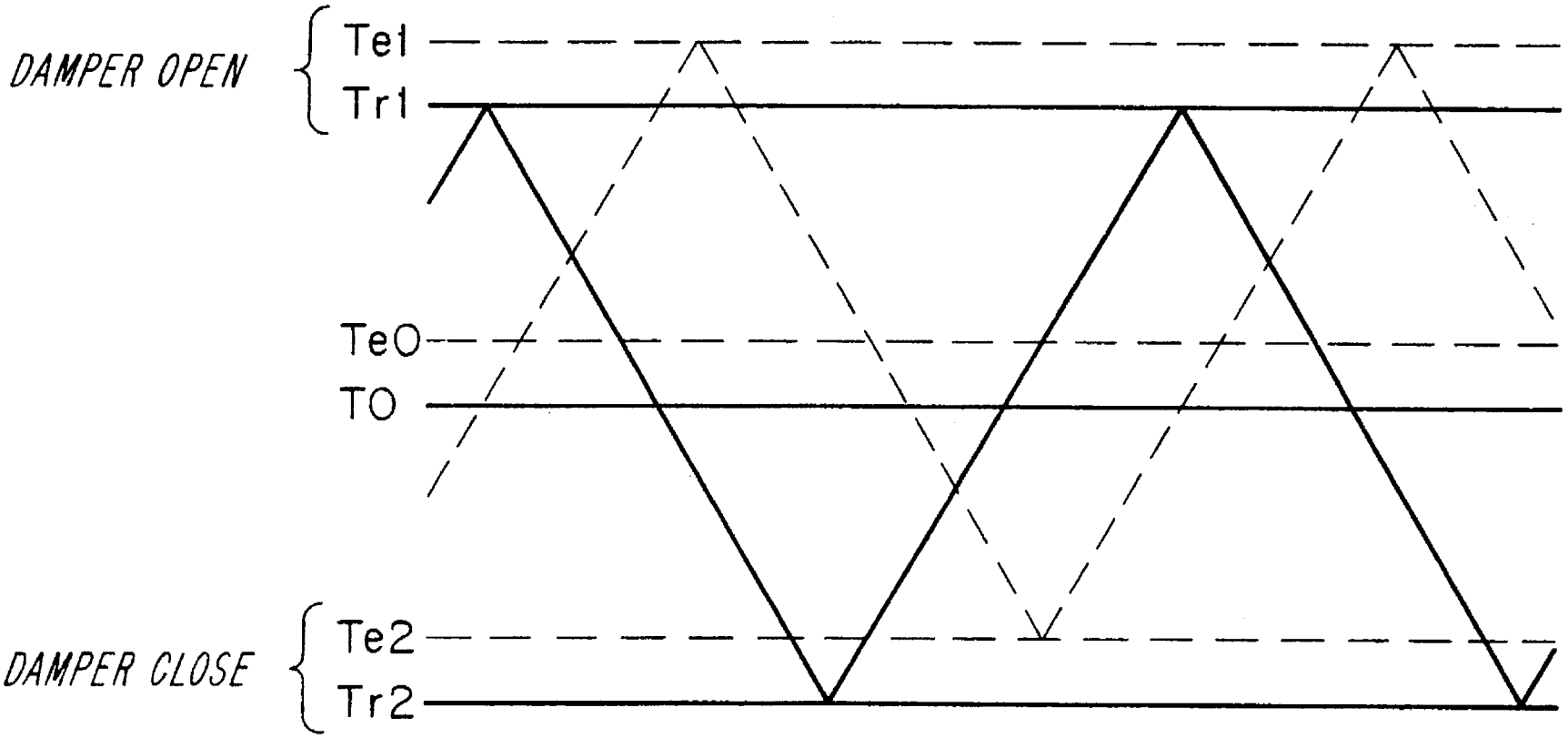
FIG. 2 (PRIOR ART)
FIG. 2 is a schematic drawing of a temperature characteristic within the conventional refrigerator for explaining how a temperature sensor cannot detect the temperature in the refrigerator accurately due to an outside temperature.

First of all, when the power is supplied to the refrigerator, the control unit 40 shown in FIG. 1 is initialized. Then, when the user operates the refrigerator to a desired state by utilizing the operation unit 10 (or, if the refrigerator has already been operated), the control unit 40 drives a compressor (not shown).

Furthermore, the control unit 40 detects the outside temperature of the refrigerator by way of the temperature sensing unit 20 at step (S10).

The temperature sensing unit 20 is not shown for convenience sake.

The control unit 40 compares the outside temperature detected at step (S10) with a predetermined temperature (approximately 20 degrees celsius ) at step (S12).

In other words, when the outside temperature of the refrigerator becomes around 20 degrees celsius, it is assumed that there arises a difference between the actual temperature in the refrigerator and the detected temperature detected by the sensor, which requires that temperature compensation to be provided.

As a result of discrimination at step (S12), if the outside temperature goes over a first predetermined temperature (approximately 20 degrees celsius), a temperature compensation flag (FLAG) is caused to be set at step (S13). (FLAG - 1).

As the result of the discrimination at step (S12), if the outside temperature is not above the first predetermined temperature of approximately 20 degrees celsius), the outside temperature is compared at step (S14) with a second predetermined temperature (approximately 17 degrees celsius) established to be lower than the first predetermined temperature.

As a result of comparative discrimination at step (S14), if the outside temperature is below the second predetermined temperature (approximately 17 degrees celsius), there arises no need for temperature compensation, and the temperature compensation flag (FLAG) is not set. (FLAG - o).

As the result of the discrimination at step (S14), if the outside temperature is not below the second predetermined temperature (approximately 17 degrees celsius), the temperature compensation flag is caused to remain as is.

In other words, a prior established state of the temperature compensation flag is maintained.

When it is has been determined whether or not the temperature should be compensated as described above, the control unit 40 determines whether the temperature inputted by the user at step (S20) is within a controllable range of the refrigerator.

In other words, when noise and the like are input to the control unit 40, there are cases when the temperature inputted by the user is not accurately input to the control unit 40 and is recognized at the control unit 40 as a temperature which the refrigerator is incapable of attaining, thereby creating the risk of an erroneous operation.

The step 20 (S20) is accordingly intended to prevent the aforesaid risk.

As a result of discrimination at step (S20), if the temperature imputted to the control unit 40 by the user is within the controllable range of the refrigerator, the control unit 40 causes a display unit 50 to display the temperature inputted by the user, step (S24), and that temperature becomes a target temperature at which the refrigerator is set.

However, if as a result of the discrimination at the step 20 (S20), the temperature inputted by the user is not within the controllable range of the refrigerator, the control unit 40 selects at step (S22) one temperature among establishable temperatures in the refrigerator and the display unit 50 displays that selected temperature to step (24) as the target temperature.

In other words, temperatures in a conventional refrigerator are established as "high", "medium high", "medium", "medium low" and "low", and one of the same is selected ("medium" is selected in the present invention) to thereby be displayed by way of the display unit 50.

Then, the control unit 40 determines whether the quick cooling (quick freezing) function has been selected by the user, step (S30).

If it is determined that the quick freezing function has been selected at step (S30), the control unit 40 sets the target temperature in the refrigerating chamber at a lowest level ("low" in the present invention), while also closing the damper.

In other words, if the quick freezing function is selected, the target temperature in the refrigerator is set at the lowest level and the damper is positioned (minimize) the flow of cold air in order to interdict from the freezing chamber to the refrigerating chamber, so that food stored in the freezing chamber can be frozen more quickly.

If it is determined that the quick freezing function has not been selected at step (S30), the control unit 40 determines whether the performance test function has been selected, step (S40).

If it is determined at step 40 (S40) that the performance test function has been selected, the control unit 40 sets the target temperature in the refrigerating chamber at the highest level ("high" in the present invention) at step (S41), so that the performance of the refrigerator can be tested by the user.

If it is determined that the performance test function has not been selected at the step (S40), the control unit 40 sets as the target temperature inputted by the user, step (S42), and determines whether the temperature compensation flag has been set, step (S50). (FLAG←1).

As a result of discrimination at the step (S50), if the temperature compensation flag has been set (FLAG←1), the control unit 40 compensates at step (S52) the temperature inputted by the user to thereby perform the damper control step. For example, the target temperature range which is automatically determined as a function of the target temperature "To" set by the user can have its upper and lower limits automatically reduced by an amount equal to the compensation value equal to Teo minus To. Consequently, the respective levels at which the detected inside temperature coincide with the upper and lower limits Tr1, Tr2 of the target temperature range will be lowered by an amount equal to the compensation value.

The damper control step can be described as below.

First of all, the control unit 40 determines whether or not the damper has reached an opening time, i.e, whether it is time for the damper to open, step (S60).

In other words, the control unit 40 determines whether the detected temperature of the refrigerating chamber detected by the temperature sensing unit 20 (which detected temperature has been compensated for by being raised, as noted above) is above the first reference temperature (Tr1).

As a result of the discrimination at the step (S60), if the damper has reached the opening time, it is determined at step (S66) whether the damper is performing a closing operation, and if the damper has not reached the opening time, it is determined at step (S62) whether the damper has reached a closing time, i.e., whether the damper should be closed.

The control unit 40 compares at the step (S62) the temperature of the refrigerating chamber detected by the temperature sensing unit 20 (i.e., a compensated-for detected temperature) with the second reference temperature (Tr2), and if the detected temperature is below the second reference temperature Tr2, it is determined that the damper has reached the closing time.

As a result of the discrimination at the step (S62), if the damper has reached the closing time, the damper is checked at step (S67) as to whether the same is performing the opening operation, and if the damper has not reached the closing time, the damper is checked at step (S64) as to whether the same is performing the closing operation.

As a result of the discrimination at the step (S64), if the damper is performing the closing operation, a discrimination is made at step (S67) as to whether the damper is performing the opening operation, and if the damper is not performing the closing operation, a discrimination is made at step (S65) as to whether the damper is performing the opening operation.

If the damper is performing the opening operation at the step (S65), a discrimination is made at step (S66) as to whether the damper is performing the closing operation, and if the damper is not performing the opening operation, the step (S10) is performed.

As a result of the discrimination at the step (S66), if the damper is performing the closing operation, a discrimination is made at step (S67) as to whether the damper is performing the opening operation, and if the damper is not performing the closing operation, a discrimination is made at step (S70) as to whether the damper has completed the closing operation.

As a result of the discrimination at the step (S70), if it is determined that the damper has completed the opening operation, step (S78) is performed, and if it is determined that the opening operation has not been completed, a discrimination is made at step (S72) as to whether a lead switch of the damper sensing unit 30 has been reversed.

As a result of the discrimination at the step (S72), if the lead switch has not been reversed, which means that the damper is still performing the opening operation, the control unit 40 keeps outputting a control signal to the damper driving unit 60, step (S73), thereby maintaining the opening operation.

Furthermore, the control unit 40 outputs the control signal to the display unit 50 to thereby display that the damper is performing the opening operation.

AS a result of the discrimination at the step (S72), if the lead switch is determined as being in the reversed state, which means that the damper has completed the opening operation, it can be concluded that the lead switch has been reversed prematurely, since it is already known from step S70 that the opening operation is still occurring. However, it can also be concluded that the opening operation is almost completed (since the lead switch has been reversed). As a result, the control unit 40 keeps outputting the control signal to the damper driving unit 60, step (S74) thereby operating an overrun timer and maintaining the opening operation during an overrun time.

Then, a discrimination is made at step (S76) as to whether the overrun time has elapsed, and if the overrun time has not elapsed, the step (S10) is performed, and if the overrun time has elapsed, step (S78) is conducted.

The control unit 40 outputs the control signal to the damper driving unit 60 at the step (S78) to thereby stop the operation of damper and to reset the overrun timer at step (S80).

After the overrun timer is reset the control unit 40 outputs the control signal to the display unit 50, step (S82), to thereby display that the opening operation of the damper has been completed, and performs the step (S10).

Meanwhile, as a result of the discrimination at the step (S67), if the damper is performing the opening operation, a discrimination is made as to whether the damper is performing the closing operation, step (S66), and if the damper is not performing the opening operation, a discrimination is made, step (S90) as to whether the closing operation has been completed.

As a result of the discrimination at the step (S90), if it is determined that the damper has completed the closing operation, step (S94) is performed. If it is determined that the damper has not completed the closing operation, a discrimination is made at step (S92) as to whether the lead switch of the damper sensing unit 30 has been reversed.

As a result of the discrimination at the step (S92), if it is determined that the lead switch has not been reversed, which means that the damper is still performing the closing operation, the control unit 40 keeps outputting the control signal to the damper driving unit 60 at step (S93), thereby maintaining the closing operation.

Furthermore, the control unit 40 outputs the control signal to the display unit 40 to thereby display that the closing operating of the damper is under process.

As a result of the discrimination at the step (S92), if it is determined that the lead switch has been reversed, which means that the closing operation of the damper has been completed, it can be concluded that the lead switch has been reversed prematurely, since it is already known from step S90 that the closing operation is still occurring. However, it can also be concluded that the closing operation is almost completed (since the lead switch has been reversed). As a result, the control unit 40 outputs the control signal to the damper driving unit 60 at step (S94), thereby stopping the closing operation of the damper.

Then, the control unit 40 resets the overrun timer, step (S96), and outputs the control signal to the display unit 50 to thereby display that the closing operation of the damper has been completed, and performs the step (S10).

In the aforesaid description, explanation that the step (S10) is performed after the steps (S65, S73, S76, S86, S93 and S96) are different from the actuality, and in actual fact, other subroutines are performed and then the step (S10) is performed.

As seen from the foregoing, the temperature control method of the refrigerator according to the present invention prevents inaccuracy of the temperature control according to variations of the outside temperature, and prevents an erroneous operation resulted from the noise and the like, and at the same time, causes the quick freezing to be realized and controls the baffle of the damper accurately to thereby obtain an effect of an accurate temperature control.

The foregoing description and the drawings are illustrative and are not to be taken as limiting.

Still other variations and modifications are possible without departing from the spirit and scope of the present invention.

What is claimed is:

1. A temperature control method for a refrigerator having an air flow control device for controlling cool air flow to a food storage chamber of the refrigerator, said method comprising the steps of:

A) manually setting a target temperature for the chamber;

B) automatically determining a target temperature range as a function of the target temperature, the target temperature range having upper and lower limits;

C) detecting an inside temperature of the chamber;

D) actuating the air flow control device for increasing the air flow to the chamber when the detected inside temperature coincides with the upper limit of the target temperature range, and for decreasing the air flow to the chamber when the detected inside temperature coincides with the lower limit of the target temperature range;

E) detecting an outside temperature of the refrigerator, and comparing the detected outside temperature with a reference temperature; and F) automatically reducing the upper and lower limits of the target temperature range when it is determined from step E that the detected outside temperature exceeds the reference temperature.

2. The method according to claim 1 and further including, subsequent to step A, the steps of comparing the target temperature manually set by the user with an achievable range of temperatures which the refrigerator is capable of achieving, and automatically re-setting the target temperature to a predetermined value within the achievable range when the target temperature set manually by the user lies outside the achievable range.

3. The method according to claim 2, wherein the chamber comprises a refrigerating chamber, the refrigerator further comprising a freezing chamber, the air flow control device comprising a damper for controlling cool air flow from the freezing chamber to the refrigerating chamber, the method further including a quick-freezing mode for rapidly lowering a temperature in the freezing chamber, the quick freezing mode comprising the steps of manually actuating a quick-freeze actuator for causing the target temperature of the refrigerating chamber to be automatically set to a predetermined low value while causing the damper to be automatically placed in a position minimizing the cool air flow to the refrigerating chamber.

4. The method according to claim 1, wherein the air flow control device comprises a damper movable between open and closed positions by the operation of a damper actuator, said method further including the steps of detecting a damper-arrival signal produced by a sensor disposed at one of the damper open and closed positions, and continuing to operate the damper actuator for a predetermined time period thereafter to compensate for a damper-arrival signal that is prematurely produced.

* * * * *